US010180270B2

(12) United States Patent
Bates

(10) Patent No.: US 10,180,270 B2
(45) Date of Patent: Jan. 15, 2019

(54) MODULAR COOLING SYSTEM FOR HIGH-RISE BUILDING

(71) Applicant: Rheem Manufacturing Company, Atlanta, GA (US)

(72) Inventor: Douglas Bates, Atlanta, GA (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 0 days.

(21) Appl. No.: 15/462,406

(22) Filed: Mar. 17, 2017

(65) Prior Publication Data

US 2018/0266732 A1 Sep. 20, 2018

(51) Int. Cl.
*F25B 7/00* (2006.01)
*F25B 43/02* (2006.01)

(52) U.S. Cl.
CPC ..... *F25B 7/00* (2013.01); *F25B 43/02* (2013.01); *F25B 2500/18* (2013.01)

(58) Field of Classification Search
CPC ..... F25B 31/002; F25B 31/004; F25B 43/02
USPC ..... 62/84, 498
See application file for complete search history.

(56) References Cited

U.S. PATENT DOCUMENTS

2016/0025360 A1* 1/2016 West ..... F24F 3/16 95/170
2016/0223219 A1* 8/2016 Lau ..... F24D 19/1084

FOREIGN PATENT DOCUMENTS

WO WO 2008/047988 4/2008
WO WO 2016/166988 10/2016

OTHER PUBLICATIONS

International Search Report for PCT/US2018/021997 dated Aug. 2, 2018.

* cited by examiner

*Primary Examiner* — Melvin Jones
(74) *Attorney, Agent, or Firm* — King & Spalding LLP

(57) ABSTRACT

An air conditioning system for a high-rise building includes a condenser unit and a compressor separate from the condenser unit and in fluid communication with the condenser unit. The compressor is to be located at a floor of a high-rise building that is below a location of the condenser unit at a roof top of the high-rise building. The system may also include an oil separator to separate oil from a refrigerant. The oil separator is in a path of the refrigerant from the compressor to the condenser unit, where the oil separator is distal from the condenser unit and proximal to the compressor.

19 Claims, 6 Drawing Sheets

MODULAR COOLING SYSTEM FOR HIGH-RISE BUILDING

TECHNICAL FIELD

The present disclosure relates generally to air conditioning, and more particularly to cooling systems and methods for high-rise buildings.

BACKGROUND

Air conditioning systems for high-rise buildings often have compressor/condenser units located on a roof top of a building and air handling units with evaporators located below the roof and at or close to the particular floors of the building that are air conditioned by the systems. Some buildings have some compressor/condenser units that are located at a lower floor of the building because of limitations on maximum vertical separation between the compressor/condenser units and the evaporators. For example, the vertical separation between evaporator units and the compressor/condenser units is typically limited to about 200 feet.

In general, the limitation on the maximum vertical distance between compressor/condenser units and the evaporator units of high-rise buildings is a result of lubrication oil entering the refrigerant lines of the cooling systems. To illustrate, lubrication oil is typically used to lubricate a compressor of an air conditioning system. Although the lubrication oil is intended to remain in the compressor, some of the oil may enter the refrigerant line at the compressor and circulate through the system along with the refrigerant. The path of the lubrication oil that enters the refrigerant line includes the piping from the compressor, that is typically located at the roof top in the same unit or otherwise along with the condenser unit, to the air handling unit with the evaporator that is located at a lower elevation than the compressor and condenser unit. The weight of the lubrication oil in the refrigerant line can limit the maximum vertical separation between the evaporator unit and the compressor. To illustrate, the maximum vertical separation between the evaporator unit and the compressor has to be limited to avoid excessive accumulation of the oil in the evaporator unit, which can result in a reduced efficiency and possible damage to the air conditioning system.

Locating compressor/condenser units at the roof top of a high-rise building may also pose additional challenges related to billing occupants/tenants individually because of the required high voltage wiring. Further, the landlord of the building, instead of the occupants/tenants, is often responsible for the proper operation and maintenance of the compressor/condenser units partly because of the inconvenient location of the units to occupants/tenants. Additionally, locating additional compressor/condenser units at a lower floor of the building for air conditioning of lower floors may take up a large area that can otherwise be used as for income generating purposes. Thus, a solution that enables providing air conditioning for high-rise buildings efficiently and cost effectively is desirable.

BRIEF DESCRIPTION OF THE DRAWINGS

Reference will now be made to the accompanying drawings, which are not necessarily drawn to scale, and wherein.

Figure 1:
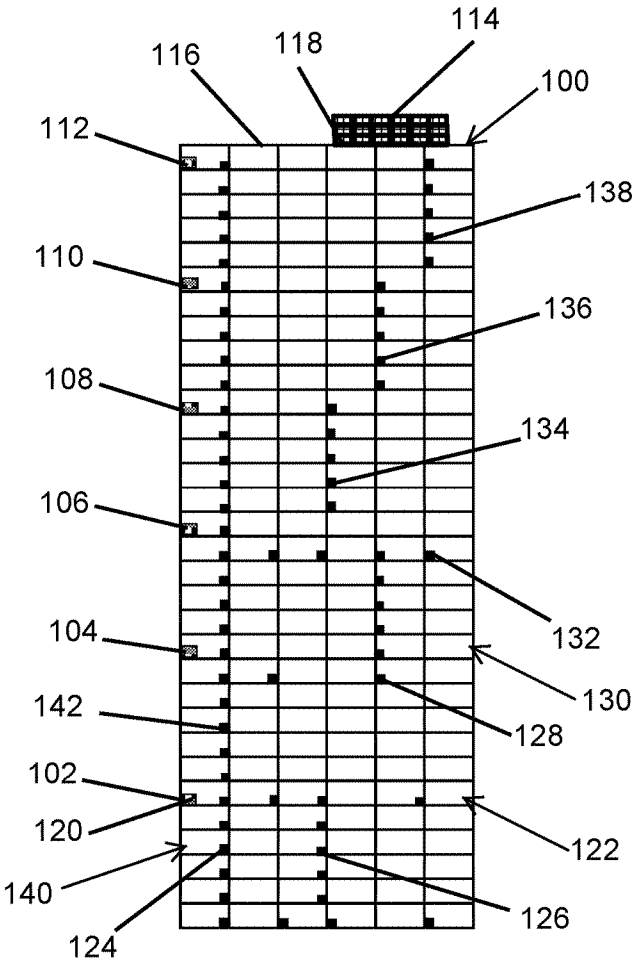
FIG. 1 illustrates air conditioning systems of a high-rise building according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

SUMMARY

The present disclosure relates generally to air conditioning, and more particularly to cooling systems and methods for high-rise buildings. As used herein, "high-rise" buildings refers to buildings that are twenty stories tall or taller. In an example embodiment, an air conditioning system for a high-rise building includes a condenser unit and a compressor separate from the condenser unit and in fluid communication with the condenser unit. The compressor is located at a floor of a high-rise building that is below a location of the condenser unit at a roof top of the high-rise building. The system may also include an oil separator to separate oil from a refrigerant. The oil separator is in a path of the refrigerant from the compressor to the condenser unit, where the oil separator is distal from the condenser unit and proximal to the compressor.

In another example embodiment, an air conditioning system for a high-rise building includes a condenser unit located at a roof top of a high-rise building. The system further includes a compressor located at a floor of the high-rise building, where the floor is at a lower elevation than the roof top. The system also includes an oil separator located at the floor of the building and in a path of a refrigerant from the compressor to the condenser unit. The oil separator is located to separate oil from the refrigerant.

In another example embodiment, a method of providing an air conditioning system for a high-rise building includes connecting a compressor to an oil separator by a first hot gas refrigerant pipe. The compressor may be at a first floor of a high-rise building that is below a roof top of the high-rise building. The method further includes connecting the oil separator to a condenser unit by a second hot gas refrigerant pipe, where the condenser unit is at the roof top of the high-rise building. The oil separator is in a path of a refrigerant from the compressor to the condenser unit to separate oil from the refrigerant. The method also includes connecting the condenser unit to an air handler by a liquid refrigerant pipe.

These and other aspects, objects, features, and embodiments will be apparent from the following description and the appended claims.

DETAILED DESCRIPTION OF EXAMPLE EMBODIMENTS

The present disclosure relates generally to air conditioning, and more particularly to cooling systems and methods for high-rise buildings such as high-rise residential buildings. Using an air conditioning system that includes a compressor located at a lower location in a high-rise building than the condenser unit of the system, and by separating lubricant oil from the refrigerant flowing from the compressor to the condenser unit, air conditioning may be provided to units of a high-rise building more efficiently and cost effectively than traditional systems and methods.

Turning now to the drawings, FIG. 1 illustrates air conditioning systems of a high-rise building 100 according to an example embodiment. As illustrated in FIG. 1, the building 100 has a roof top 116 and several floors that may each include individual units, such as residential apartments, office spaces, shops, etc. One or more air conditioning systems of the air conditioning systems of the building 100 shown in FIG. 1 may be used to provide air conditioning, in particular, cooling, for an apartment unit or another space of the building 100.

In some example embodiments, each air conditioning system of the building 100 may include a compressor, a condenser unit, an oil separator, and an air handler. In each air conditioning system, a compressor may be located at a particular floor of the building 100, the condenser unit may be at a roof top 116 of the building 100, the oil separator may be in a path of a refrigerant between the compressor and the condenser unit and located at the same floor as the compressor, and the air handler may be at the same floor as the compressor or at a nearby floor above or below the compressor.

In some example embodiments, the compressors of multiple air conditioning systems of the building 100 may be located at a particular floor of the building 100. For example, a plurality of compressors 102 may be located at a floor 122 of the building 100. The compressors 102 may be located in a mechanical room that takes up a limited space at the floor 122 or in another convenient location at the floor 122. Other groups of compressors 104-112 may similarly be located at other floors of the building 100. For example, the plurality of compressors 104 may be located at a floor 130 a few floors above the compressors 102, and the plurality of compressors 106 may be located a few floors above the plurality of compressors 104. The plurality of compressors 108 may be located a few floors above the plurality of compressors 106, and the plurality of compressors 110 may be located a few floors above the plurality of compressors 108. The plurality of compressors 112 may be located a few floors above the plurality of compressors 110.

The number of floors between two groups of compressors (e.g., between the compressors 112 and the compressors 110) may be more or fewer than shown in FIG. 1 without departing from the scope of this disclosure. For example, the compressors 104 may be more or fewer than six floors above the compressors 102. In some example embodiments, the compressors may be separated by the same number of floors. For example, the compressors may be located every fourth floor of the building 100. In some alternative embodiments, the number of floors between two groups of compressors may be different from the number of floors between two other groups of compressors.

In some example embodiments, the oil separators of multiple air conditioning systems of the building 100 may be located at the same floor of the building 100 as the compressors of the particular air conditioning systems. For example, oil separators 120 may be located at the floor 122, where the compressors 102 are located. To illustrate, an air conditioning system may include one of the compressors 102 and one of the oil separators 120, and both the compressor and the oil separator may be located in a mechanical or rack room at the floor 122. Oil separators of other air conditioning systems of the building 100 may similarly be located at the same floors as the respective compressors 104-112.

As illustrated in FIG. 1, condenser units 114 of the air conditioning systems of the building 100 may be located on the roof top 116. In some example embodiments, all condenser units of the air conditioning systems of the building 100 may be located at the roof top 116. The condenser units 114 may be modular and may be mounted as banks of 2 or more stackable modules and may be individually accessible for repair and maintenance with minimal or no disruption to other condenser units. Each condenser unit may include a fan, condenser coil, and necessary valves as can be understood by those of ordinary skill in the art with the benefit of this disclosure. Because the electrical power required to operate the fan of each condenser unit is relatively low (e.g., approximately 3 amps of current), a relatively smaller gauge wire (e.g., a 14 gauge wire) may be run to the roof top 114, for example, from the respective compressor.

In some example embodiments, an air conditioning system of the building 100 may include one of the compressors 102, one of the oil separators 120, and one of the condenser units 114 (e.g., a condenser unit 118). The oil separator is physically located to separate and remove oil from the refrigerant that flows from the compressor at the floor 122 to the condenser unit at the roof top 116. In general, the oil separator in an air conditioning system of the building 100 is located proximal to the respective compressor and distal from the respective condenser unit. Because the refrigerant is in a gaseous form between the compressor and the condenser unit of each air conditioning system of the building 100, the hot gaseous refrigerant, which is mostly free of oil past the oil separator, can travel a much longer vertical distance through the hot gas refrigerant line between the compressor and the condenser unit than possible for a low pressure refrigerant to flow between an air handler and the compressor/condenser unit of typical air conditioning systems. Because the oil separator may be at the same floor or even maybe in the same room as the compressor, the hot gas refrigerant travels a significant or all of the vertical distance to the condenser unit at the roof top mostly free of oil that could have reduced the maximum vertical separation.

In general, each air handler throughout the building 100 along with a respective compressor, a respective oil separator, and a respective condenser unit of condenser units 114 at the roof top 116 can provide cooling to the various building units and spaces of the building 100. In some example embodiments, an air handler of an individual air conditioning system of the building 100 is located at the same floor as the compressor of the particular air conditioning system or at a nearby floor above or below the compressor of the particular air conditioning system. For example, the air handler of each air conditioning system of the building 100 may be located inside a building unit (e.g., in a utility closet of an apartment unit) that is air conditioned by the particular air conditioning system.

To illustrate, an air conditioning system for a particular building unit (e.g., an apartment unit or an office space) at a floor 140 of the building 100 may include one of the compressors 102, one of the oil separators 120, one of the condenser units 114 (e.g., the condenser unit 118), and an air handler 124 that is also at the floor 140. Another air handler 126, also located at the floor 140, may be in another air conditioning system that includes another one of the compressors 102 at the floor 122, another one of the oil separators 120 at the floor 122, and another one of the condenser units 114 at the roof top 116. For example, the air conditioning system that includes the air handler 124 and the air conditioning system that includes the air handler 126 may be used for air conditioning of two separate building units of the building 100 at the floor 140. Alternatively, the two systems may be used to air condition the same unit that is at the floor 140. Other air conditioning systems of the building 100 may each include yet another respective one of the compressors 102 at the floor 122, another respective one of the oil separators 120 at the floor 122, another respective one of the condenser units 114 at the roof top 116, and another respective air handler that is at or below the floor 122.

In some example embodiments, the air handler 128, which is one floor below the compressors 104 at the floor 130, may similarly be included in another air conditioning system that includes one of the compressors 104, a respective condenser unit at the roof top 116, and an oil separator that is located near the compressors 104. Other air handler, such as the air handler 142, at or below the floor 130 and at or above the floor 122 may be part of air conditioning systems that include remaining ones of the compressors 104 and associated oil separators at the floor 130 and respective ones of the condenser units 114 at the roof top 116.

The air handler 132 may similarly be included in another air conditioning system that includes one of the compressors 106, a respective condenser unit at the roof top 116, and an oil separator that is located close to the compressors 106. Other air handlers at or below the location of the compressors 106 and at or above the floor 130 may be part of air conditioning systems that include remaining ones of the compressors 106 and associated oil separators, and respective condenser units of the condenser units 114 at the roof top 116.

The air handler 134 may similarly be included in another air conditioning system that includes one of the compressors 108, a respective condenser unit at the roof top 116, and an oil separator that is located close to the compressors 108. Other air handlers at or below the location of the compressors 108 and at or above the location of the compressors 106 may be part of air conditioning systems that include remaining ones of the compressors 108 and associated oil separators, and respective condenser units of the condenser units 114 at the roof top 116.

The air handler 136 may similarly be included in another air conditioning system of the building 100 that includes one of the compressors 110, a respective condenser unit at the roof top 116, and an oil separator that is located close to the compressors 110. The air handler 138 may similarly be included in another air conditioning system that includes one of the compressors 112, a respective condenser unit at the roof top 116, and an oil separator that is located close to the compressors 112.

By providing a vertical separation of the compressor from the condenser unit of each air conditioning system and by separating the oil from the gaseous refrigerant in the hot gas refrigerant pipe between the compressor and the condenser unit, the air conditioning systems shown in FIG. 1 can efficiently and cost effectively provide air conditioning for high-rise buildings, such as the building 100. Because the compressors are not on the roof top of the building, large gauge wires are not required to be routed to the roof top. Instead of a control box that is typically required at the roof top with traditional air conditioning systems, a junction box is adequate to support the electrical connections. Further, metering of air conditioning electricity usage by individual building units is also simplified. Further, the structural burden on the roof top is reduced because the roof top does not need to support the compressors.

In some example embodiments, the locations of the compressors, oil separators, and air handlers of the system may be different from those shown in FIG. 1 without departing from the scope of this disclosure. More or fewer compressors, oil separators, air handlers, and condenser units than shown may be included in the air conditioning systems of the building 100 without departing from the scope of this disclosure. Although the building 100 is shown as having a particular number of floors, in alternative embodiments, the building may have more or fewer floors and may also have a different profile than shown without departing from the scope of this disclosure. Although the condenser units 114 are shown at a particular location on the roof top 116, the condenser units 114 may be located at a different position (e.g., a rack room) without departing from the scope of this disclosure. Although particular vertical relationship is described between the air handlers and related air compressors, in some alternative embodiments, the relationship may be modified without departing from the scope of this disclosure. In some example embodiments, the air conditioning systems shown in FIG. 1 may include heating systems, such as tankless water heater systems, that may be assigned to individual building units (e.g., apartment units) of the building 100.

Figure 2:
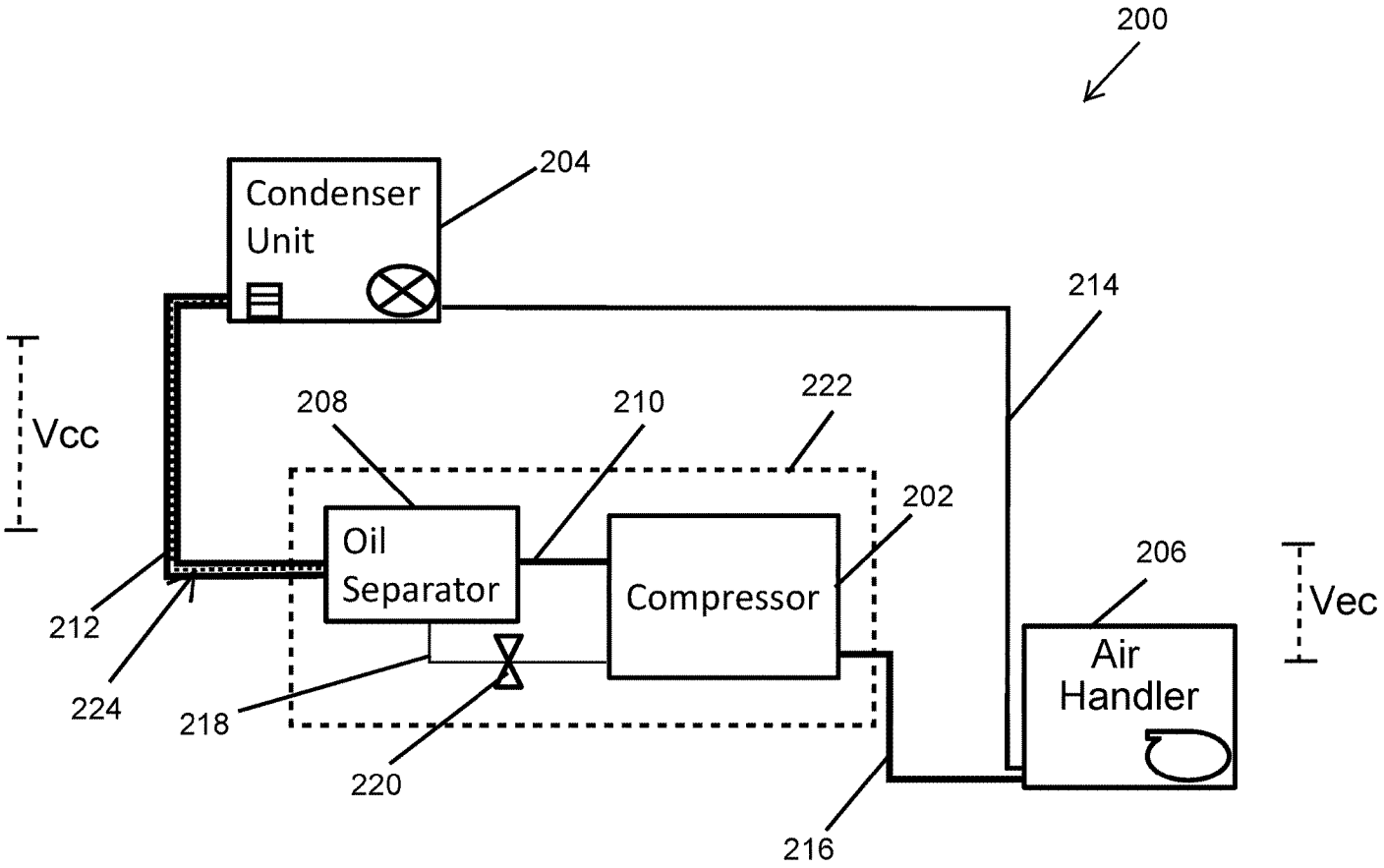
FIG. 2 illustrates an air conditioning system for a high-rise building according to an example embodiment.

FIG. 2 illustrates an air conditioning system 200 for a high-rise building according to an example embodiment. For example, the system 200 may correspond to any one of the individual air conditioning systems shown in FIG. 1. Referring to FIGS. 1 and 2, in some example embodiments, the system 200 includes a compressor 202, a condenser unit 204, an air handler 206, and an oil separator 208 that is between the compressor 202 and the condenser unit 204. The system 200 includes a first hot gas refrigerant pipe 210 that is connected to the compressor 202 and the oil separator 208. The system 200 also includes a second hot gas refrigerant pipe 212 that is connected to the oil separator 208 and the condenser unit 204 and that is occupied by the refrigerant 224. The compressor 202 is in fluid communication with the condenser unit 204 through the hot gas refrigerant pipes 210, 212. The oil separator 208 is located proximal to the compressor 202 and distal from the condenser unit 204 to separate and remove lubrication oil from the hot gas refrigerant flowing between the compressor 202 and the condenser unit 204.

To illustrate, the condenser unit 204 may be located at the roof top of a high-rise building such as the high-rise building 100 of FIG. 1. For example, the condenser unit 204 may be one of the condenser units 114 shown in FIG. 1. The compressor 202 may be any one of the compressors shown in FIG. 1 that is located at a floor of the building 100 below the roof top 114. For example, the compressor 202 may be one of the compressors 102 located at the floor 122 of the building 100, one of the compressors 104, or one of the compressors 112.

In some example embodiments, the oil separator 208 may be located at the same floor of a building or even in the same room, such as a mechanical room 222, as the compressor 202. Locating the oil separator 208 proximal to the compressor 202 enables the hot gaseous refrigerant that is mostly free of oil beyond the oil separator 208 to travel vertically higher than otherwise possible. For example, the vertical separation, Vcc, between the compressor 202 and the condenser unit 204 may exceed 300 feet, although the system 200 can be operated with the vertical separation, Vcc, being less or more than 300 feet.

In some example embodiments, the air handler 206 is in fluid communication with the condenser unit 204 and the compressor 202. To illustrate, the system 200 includes a liquid refrigerant pipe 214 that carries the refrigerant of the system 200 in liquid form from the condenser unit 204 to the air handler 206, and a suction pipe 216 that carries the refrigerant from the air handler 206 back to the compressor 202. In some example embodiments, the hot gas refrigerant pipe 212 may be slightly larger in diameter than the suction pipe 216.

In some example embodiments, the air handler 206 may be located at a lower floor than the compressor 202 or at the same floor as the compressor 202. By locating the air handler 206 below the compressor 202, the system 200 may be able to support a taller building than otherwise possible. That is, the vertical separation, Vec, between the air handler 206 and the condenser unit 204 may be larger than the vertical separation, Vcc.

As a non-limiting example, the air handler 206 may be approximately 70 feet below the compressor 202, enabling the system 200 to provide air conditioning for a unit (e.g., an apartment unit) of a building that is approximately 70 feet taller than otherwise possible to service with a single air conditioning system. As another non-limiting example, the air handler 206 may be approximately 40 feet below the compressor 202. That is, the suction pipe 216 may be approximately 40 feet. In some alternative embodiments, the air handler 206 may be located at a higher floor than the compressor 202 without departing from the scope of this disclosure.

In some example embodiments, the system 200 includes a return pipe 218 for returning lubrication oil separated from the hot gaseous refrigerant in the pipe 210 to the compressor 202. The system 200 may also include a valve 220, such as a solenoid valve, to control the return of the lubrication oil to the compressor 202, particularly in off cycles of the system 200. The oil separator 208 may also include an orifice to meter the return of the oil to the compressor 202.

By providing the vertical separation, Vcc, between the compressor 202 and the condenser unit 204 and by separating and removing the oil from the gaseous refrigerant in the hot gas refrigerant pipe 210, the air conditioning system 200 can efficiently and cost effectively provide air conditioning for high-rise buildings, such as the building 100 of FIG. 1. In some example embodiments, multiple air conditioning systems 200, with all their condenser units located on the roof top of a building, may be used to provide cooling for a building that is more than twice as tall as a building that can be air conditioned by traditional air conditioning systems that have the compressors and the condenser units on the roof top.

In some example embodiments, each of the refrigerant pipes of the system 200 may include multiple segments and may be separated by components such as a dryer, valves, etc. Further, the system 200 may include components (e.g., valves, etc.) other than shown in FIG. 2 without departing from the scope of this disclosure.

Figure 3:
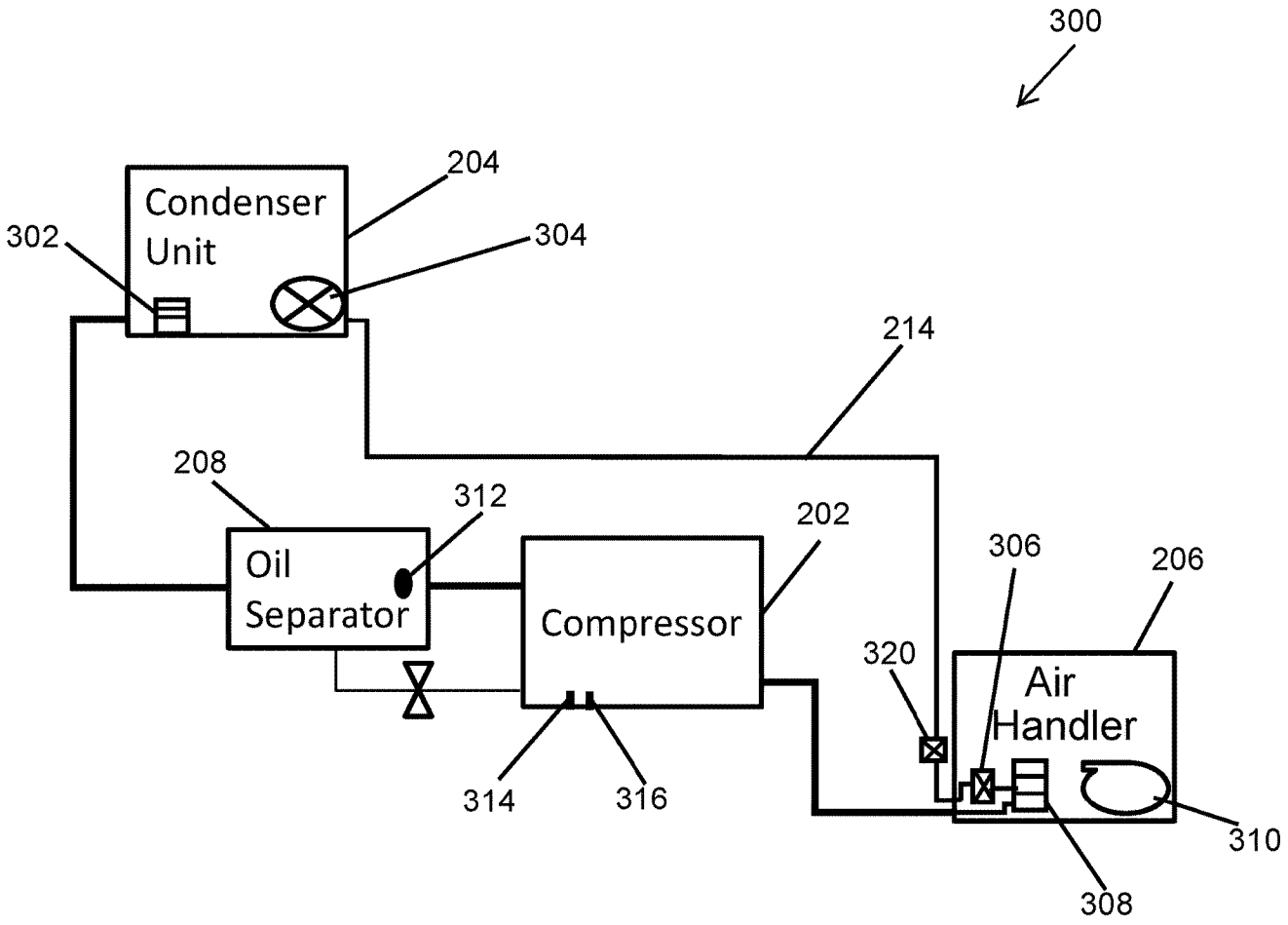
FIG. 3 illustrates an air conditioning system for a high-rise building according to another example embodiment.

FIG. 3 illustrates an air conditioning system 300 for a high-rise building according to another example embodiment. The system 300 includes the compressor 202, the condenser unit 204, the air handler 206, and the oil separator 208 that may be connected and operate in the same manner as described above with respect to the air conditioning system 200 of FIG. 2. The different components of the system 300 may be located as described above with respect to the air conditioning systems of FIG. 1 and the air conditioning system 200 of FIG. 2. In general, the description of the system 300 below is applicable to the system 200 and the individual systems of FIG. 1.

Referring to FIGS. 1-3, in some example embodiments, the condenser unit 204 includes a coil 302 and a fan 304 to blow hot air away from the coil 302. The condenser unit 204 may be mounted for either horizontal or vertical air discharge. The condenser unit 204 may also include other components such as one or more valves.

In some example embodiments, the air handler 206 includes an expansion valve 306 that controls the amount of refrigerant flow into an evaporator coil 308 of the air handler 206. The air handler 206 also includes a blower 310 that blows cold air through one or more ducts that lead to areas that are air conditioned by the systems 200, 300. In some alternative embodiments, the expansion valve 306 may be located outside of the air handler 206 without departing from the scope of this disclosure.

In some example embodiments, the system 300 may also include a valve 320, such as a solenoid valve, that controls refrigerant flow from the condenser unit 204 to the air handler 206. For example, the valve 320 may be located proximal to air handler 206 to protect the expansion valve 306 from damage, particularly during off cycles of the system 300. To illustrate, the system 300 may include the valve 320 when the vertical separation of the condenser unit 204 from the air handler 206 exceeds a threshold distance, where the weight of the liquid refrigerant in the pipe 214 may damage the expansion valve 306 during off cycles.

In some example embodiments, the oil separator 208 may also include a float 312 to control the oil flow from the oil separator 208 to the compressor 202. The compressor 202 may include a charging port 314 and an evacuation port 316 for adding and removing refrigerant from the system 300. In some alternative embodiments, the charging port 314 and the evacuation port 316 may be located at a different location than shown without departing from the scope of this disclosure.

Figure 4:
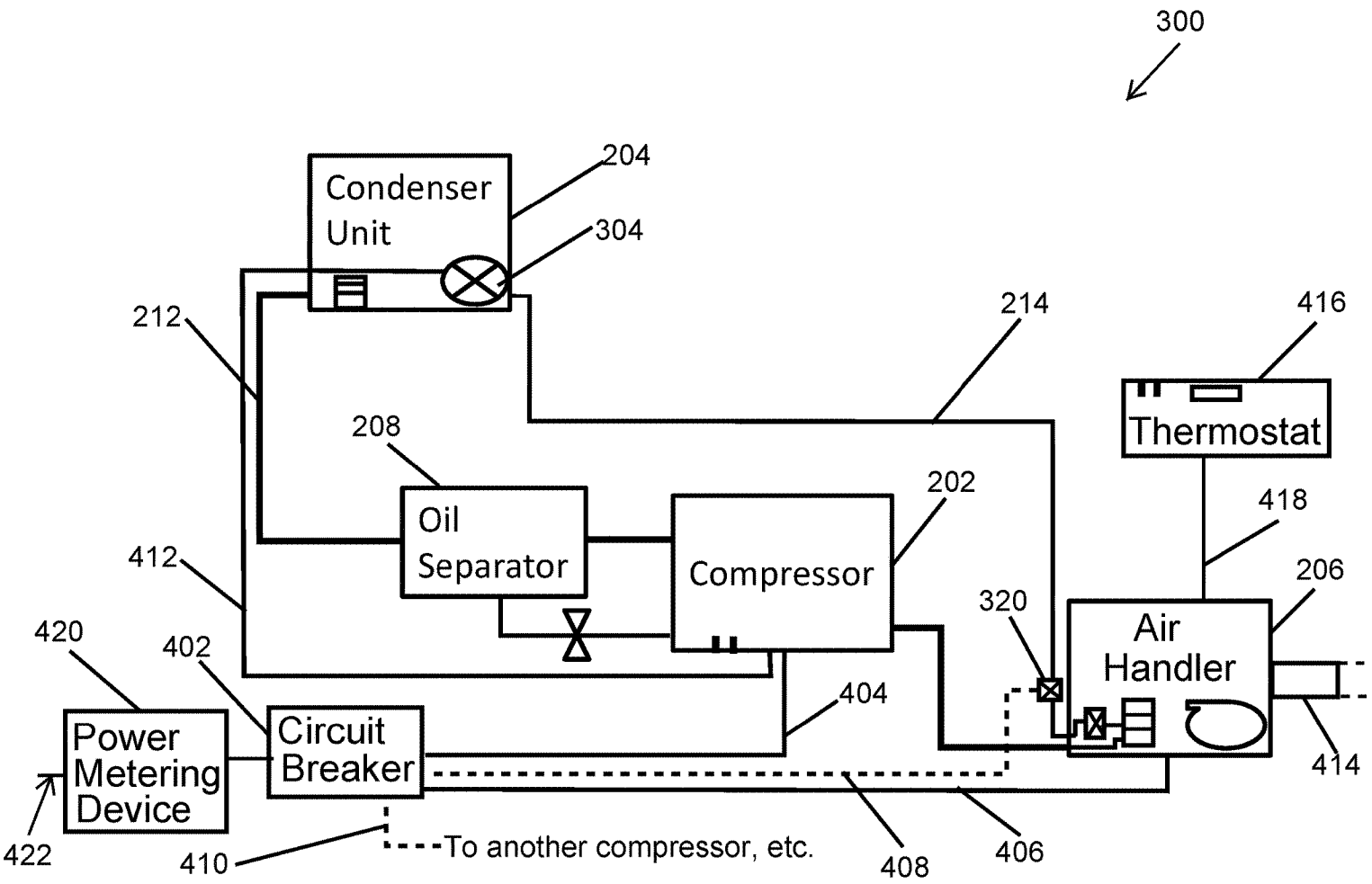
FIG. 4 illustrates the air conditioning system of FIG. 3 connected to a power metering device according to an example embodiment.

FIG. 4 illustrates the air conditioning system 300 of FIG. 3 connected to a power metering device according to an example embodiment. Referring to FIGS. 1-4, in some example embodiments, the system 300 may be electrically connected to a circuit breaker 402 of a building unit (e.g., an apartment unit of the building 100). To illustrate, the circuit breaker 402 may be connected to a power metering device 420 that meters the electrical power consumed by electrical components that are connected to the circuit breaker 402. The metering device 420 may be connected to an electricity supply line 422 that provides power (e.g., at 120 VAC) to the building unit that is air conditioned by the system 300.

In some example embodiments, electrical wires 404 connect the circuit breaker 402 to the compressor 202. Electrical wires 212 may be routed from the compressor 202 to the condenser unit 204, particularly, to the fan 304 of the condenser unit 204 at a roof top of a building. Power may be provided to the condenser unit 204 using a relay mounted in the compressor 202 or using compressor contactor. The electrical wires 412 may be relatively lower gauge wire (e.g., a 14 gauge wire) than the high gauge wires that are normally routed to a roof top to provide power to a compressor of traditional air conditioning systems. In some example embodiments, the electrical wires 412 may be routed from the compressor 202 to the condenser unit 204 along with the refrigerant pipe 212.

In some example embodiments, electrical wires 406 connect the circuit breaker 402 to the air handler 206 to power, for example, the blower 310 of the air handler 206 as well as any other components of the air handler 206 that need electrical power. The circuit breaker 402 may also be connected to the valve 320 (when present). Alternatively, the valve 320 may be connected to the electrical wires 406 or another convenient electrical wire that is connected to the circuit breaker 402.

In some example embodiments, a thermostat 416 may be electrically coupled to the air handler 206 to control the operation of the system 300. For example, the thermostat 416 as well as the air handler 206 may be located inside a building unit, such as an apartment unit in the building 100. The air handler 206 may provide cold air to the building unit through an air duct 414 based on the setting of the thermostat 416.

In some example embodiments, another air conditioning system 300 that is used to air condition the same building unit may be connected to the circuit breaker 402 via electrical connection 410. For example, an apartment unit or an office space in a building may too large to be effectively air conditioned using a single air conditioning system, and this requiring multiple air conditioning systems 300.

Because all the components of one or more air conditioning systems 300 used with a building unit can be electrically connected to the circuit breaker 402 that receives power through the power metering device 420, the building unit can be billed individually for electrical power usage by the system(s) 300.

Although the condenser unit 204 is described as being located at a roof top of a building, in some example embodiments where a building is exceedingly tall, some condenser units may be located at a floor of the building other than the roof top while maintaining the relative positions of the components of the system 300 as described above. In general, the description of the system 300 above is applicable to the system 200 of FIG. 2 and the individual systems of FIG. 1.

Figure 5:
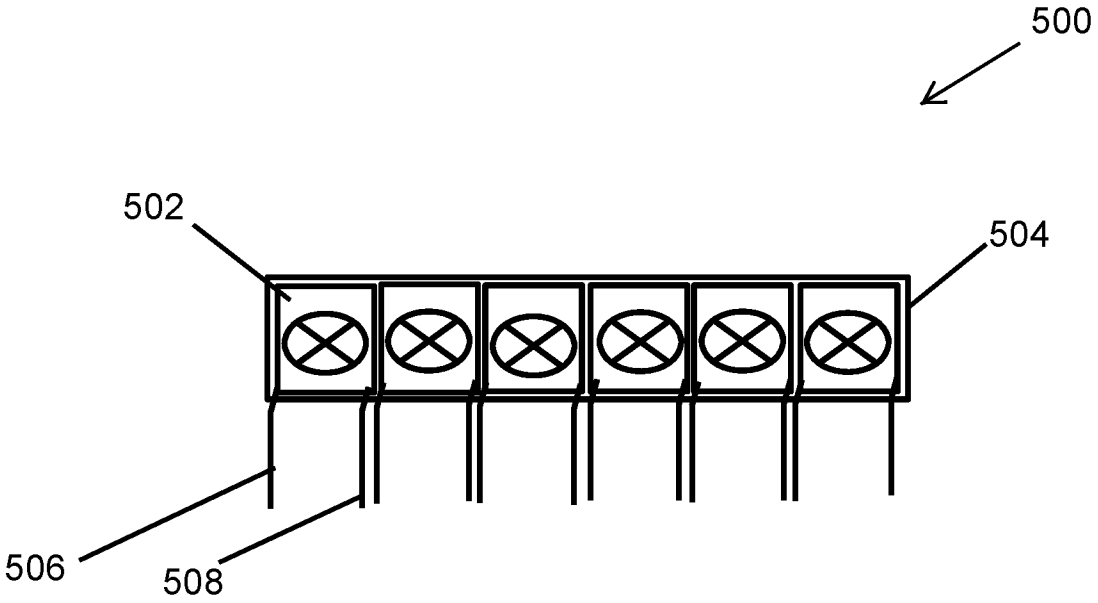
FIG. 5 illustrates modular condenser units that can be used in the air conditioning systems of FIG. 1-4 according to an example embodiment.

FIG. 5 illustrates a bank of condenser units 500 that can be used in the air conditioning systems of FIG. 1-4 according to an example embodiment. In some example embodiments, the bank 500 includes condenser units 502 that are mounted on a rack 504. Each condenser unit 502 is connected to a respective hot gas refrigerant pipe 506 and a respective liquid refrigerant pipe 508. For example, each condenser unit 502 may correspond to the condenser unit 204 described above. The condenser units 502 may be mounted on the rack 504 such that each condenser unit 502 can be individually maintained and replaced without affecting the operation of the other condenser units 502.

In some example embodiments, the bank of condenser units 500 may be stackable. Further, the condenser units 502 may be oriented for either horizontal or vertical air discharge. Although the bank 500 is shown as having six condenser units 502, in some alternative embodiments, the bank 500 may include fewer or more condenser units 502 without departing from the scope of this disclosure.

Figure 6:
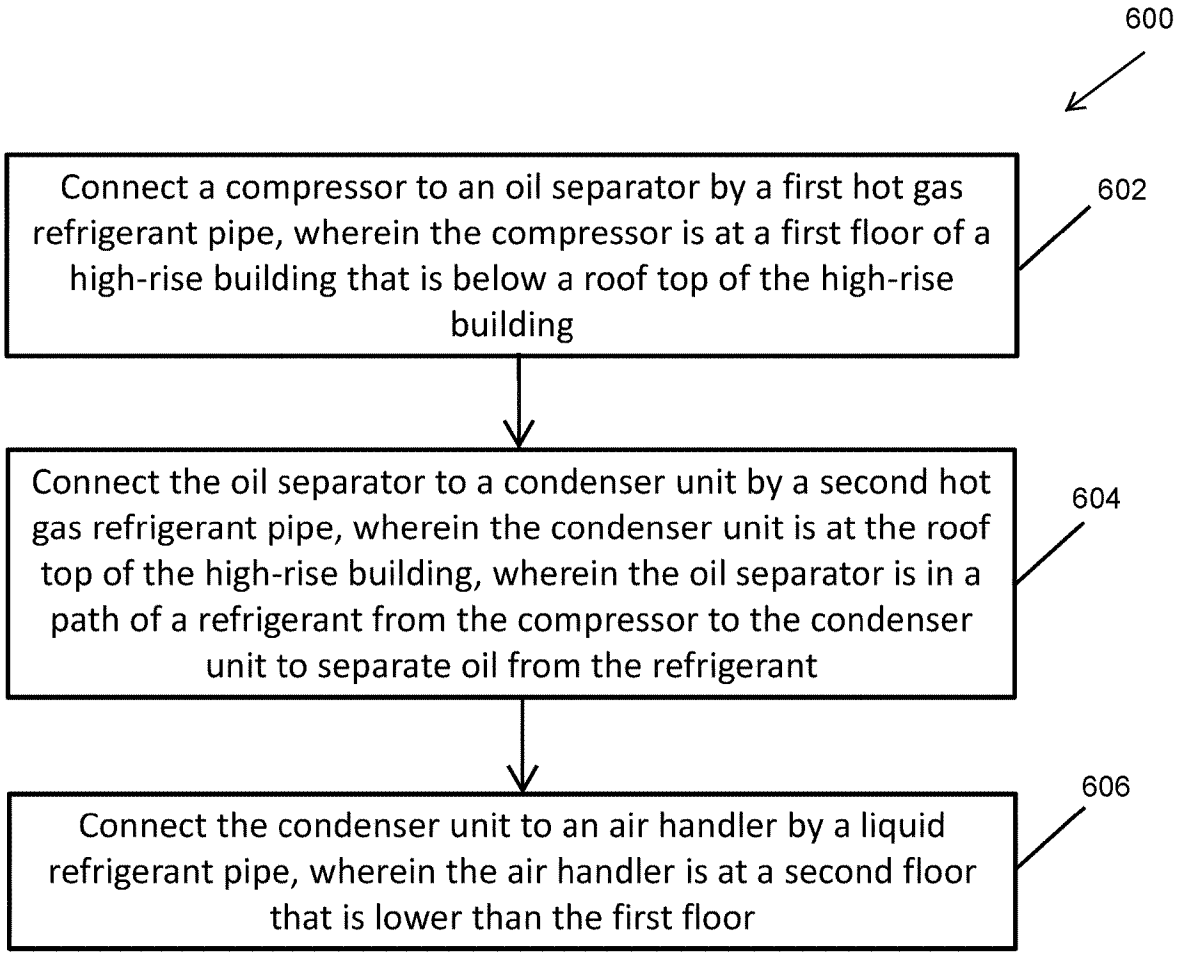
FIG. 6 illustrates a method of installing an air conditioning system for a high-rise building according to an example embodiment.

FIG. 6 illustrates a method 600 of installing an air conditioning system for a high-rise building according to an example embodiment. Referring to FIGS. 1-6, in some example embodiments, the method 600 comprises connecting a compressor to an oil separator by a first hot gas refrigerant pipe at step 602. The compressor may be at a first floor of a high-rise building that is below a roof top of the high-rise building. For example, one of the compressors 102 may be connected to one of the oil separators 120 at the floor 122 by a hot gas refrigerant pipe. As another example, the compressor 202 may be connected to the oil separator 208 by the pipe 210.

At step 604, the method 600 may include connecting the oil separator to a condenser unit by a second hot gas refrigerant pipe, where the condenser unit is at the roof top of the high-rise building. For example, one of the oil separators 120 at the floor 122 may be connected to one of the condenser units 114 at the roof top 116 of the building 100 shown in FIG. 1. As another example, the oil separator 208 may be connected to the condenser unit 204 that may be located at a roof top of a high-rise building. As more clearly illustrated in FIGS. 2-4, the oil separator is in a path of a refrigerant from the compressor to the condenser unit to separate oil from the refrigerant of the system.

At step 606, the method 600 includes connecting the condenser unit to an air handler by a liquid refrigerant pipe, where the air handler is located at a second floor that is lower than the first floor where the compressor is located. For example, the condenser unit 118 of the condenser units 114 of FIG. 1 may be connected to the air handler 124 that is located at a lower floor (i.e., the floor 140) than the respective one of the compressors 102 that is located at a higher floor (i.e., the floor 122). As another example, in the air conditioning systems 200 and 300, the condenser unit 204 may be connected to the air handler 206 that is located or to be located at a lower floor of a building than the condenser unit 204 that is located or to be located at the roof top of the building.

In some example embodiments, the method 600 further includes wiring a thermostat to the air handler 206 similar to the wiring shown in FIG. 4. The method 600 may also include connecting a valve (e.g., a solenoid valve such as the valve 320) between the condenser unit (e.g., the condenser unit 204) and the air handler (e.g., the air handler 206). In some example embodiments, the method 600 may include connecting other components such as other valves, etc. The method 600 may also include charging the air conditioning system with a refrigerant and testing the system for proper operation.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. An air conditioning system for a high-rise building, the air conditioning system comprising:

a first condenser unit located at a roof top of the high-rise building;

a second condenser unit located at the roof top of the high-rise building;

a first compressor separate from the first condenser unit and in fluid communication with the first condenser unit, the first compressor located at a first floor of the high-rise building that is below a location of the first condenser unit;

a second compressor located at a second floor of the high-rise building, wherein the second floor is below the roof top and the first floor;

a first oil separator to separate oil from a refrigerant, wherein the first oil separator is in a path of the first refrigerant from the first compressor to the first condenser unit and wherein the first oil separator is distal from the first condenser unit and proximal to the first compressor; and a second oil separator located at the second floor of the high-rise building and in a path of a second refrigerant from the second compressor to the second condenser unit, wherein the second oil separator is distal from the second condenser unit and proximal to the second compressor;

a second oil separator located at the second floor of the high-rise building and in a path of a second refrigerant from the second compressor to the second condenser unit.

2. The system of claim 1, further comprising an air handler in fluid communication with the first condenser unit and the first compressor, wherein the air handler is located at a third floor of the high-rise building that is lower than the first floor.

3. The system of claim 2, further comprising a valve located proximal to the air handler to control refrigerant flow from the first condenser unit to the air handler.

4. The system of claim 2, wherein a suction line extends between the air handler and the first compressor.

5. The system of claim 1, further comprising a return pipe providing a path between the first oil separator and the first compressor for the oil separated by the first oil separator to return to the first compressor.

6. The system of claim 1, wherein a hot gas refrigerant pipe extends between the first oil separator and the first condenser unit.

7. The system of claim 2, wherein a liquid refrigerant pipe extends between the first condenser unit and the air handler.

8. The system of claim 2, further comprising a thermostat electrically coupled to the air handler to control operations of the air conditioning system.

9. The system of claim 1, wherein the first compressor is at least 300 feet below the first condenser unit.

10. The system of claim 1, further comprising:

a first electrical wire extending between a circuit breaker and the first compressor; and a second electrical wire extending between the first compressor and the first condenser unit, wherein the second electrical wire is a lower gauge wire than the first electrical wire.

11. An air conditioning system for a high-rise building, the air conditioning system comprising:

a first condenser unit located at a roof top of a high-rise building;

a second condenser unit located at the roof top of the high-rise building;

a first compressor located at a first floor of the high-rise building, wherein the floor is at a lower elevation than the roof top;

a second compressor located at a second floor of the high-rise building, wherein the second floor is below the roof top and the first floor;

a first oil separator located at the first floor of the high-rise building and in a path of a first refrigerant from the first compressor to the first condenser unit, the first oil separator positioned to separate oil from the first refrigerant; and a second oil separator located at the second floor of the high-rise building and in a path of a second refrigerant from the second compressor to the second condenser unit.

12. The system of claim 11, further comprising an air handler in fluid communication with the first condenser unit and the first compressor, wherein the air handler is located at a third floor of the high-rise building that is below the first floor.

13. The system of claim 12, further comprising a valve located proximal to the air handler to control refrigerant flow from the first condenser unit to the air handler.

14. The system of claim 12, further comprising a thermostat electrically coupled to the air handler to control operations of the air conditioning system.

15. The system of claim 11, further comprising:

a first electrical wire extending between a circuit breaker and the first compressor; and a second electrical wire extending between the first compressor and the first condenser unit, wherein the second electrical wire is a lower gauge wire than the first electrical wire.

16. The system of claim 12, further comprising a second air handler in fluid communication with the second condenser unit and the second compressor, wherein the second air handler is located at a third floor that is below the second floor.

17. A method of providing an air conditioning system for a high-rise building, the method comprising:

connecting a first compressor to a first oil separator by a first hot gas refrigerant pipe, wherein the first compressor is at a first floor of the high-rise building that is below a roof top of the high-rise building;

connecting the first oil separator to a first condenser unit by a second hot gas refrigerant pipe, wherein the first condenser unit is at the roof top of the high-rise building, wherein the first oil separator is in a path of a first refrigerant from the first compressor to the first condenser unit to separate oil from the first refrigerant;

connecting the first condenser unit to a first air handler by a first liquid refrigerant pipe;

connecting a second compressor to a second oil separator by a third hot gas refrigerant pipe, wherein the second compressor is at a second floor of the high-rise building that is below the roof top of the high-rise building and the first floor;

connecting the second oil separator to a second condenser unit by a fourth hot gas refrigerant pipe, wherein the second condenser unit is at the roof top of the high-rise building, wherein the second oil separator is in a path of a second refrigerant from the second compressor to the second condenser unit to separate oil from the second refrigerant; and connecting the second condenser unit to a second air handler by a second liquid refrigerant pipe.

18. The method of claim 17, further comprising wiring a thermostat to the first air handler.

19. The method of claim 17, further comprising connecting a valve between the first condenser unit and the first air handler to control refrigerant flow from the first condenser unit to the air handler.

* * * * *